US010232376B2

(12) United States Patent
Capaccio et al.

(10) Patent No.: US 10,232,376 B2
(45) Date of Patent: Mar. 19, 2019

(54) PIPETTE TRAVEL LIMITING APPARATUS

(71) Applicants: Christopher James Capaccio, Baltimore, MD (US); Peter Charles Crisman, Baltimore, MD (US); Richard Joseph Kowalski, Jr., Leesburg, VA (US); Ryan Christopher Mahnke, Crownsville, MD (US)

(72) Inventors: Christopher James Capaccio, Baltimore, MD (US); Peter Charles Crisman, Baltimore, MD (US); Richard Joseph Kowalski, Jr., Leesburg, VA (US); Ryan Christopher Mahnke, Crownsville, MD (US)

(73) Assignee: NORTHROP GRUMMAN SYSTEMS CORPORATION, Falls Church, VA (US)

( * ) Notice: Subject to any disclaimer, the term of this patent is extended or adjusted under 35 U.S.C. 154(b) by 146 days.

(21) Appl. No.: 15/207,921

(22) Filed: Jul. 12, 2016

(65) Prior Publication Data

US 2018/0015451 A1 Jan. 18, 2018

(51) Int. Cl.
*B01L 9/00* (2006.01)

(52) U.S. Cl.
CPC ..... *B01L 9/54* (2013.01); *B01L 2200/025* (2013.01); *B01L 2200/026* (2013.01); *B01L 2200/14* (2013.01)

(58) Field of Classification Search
CPC .... B01L 3/021; B01L 9/54; B01L 9/06; B01L 2200/022; B01L 2200/025; B01L 2200/026; B01L 2200/14
See application file for complete search history.

(56) References Cited

U.S. PATENT DOCUMENTS 3,937,370 A 2/1976 Witty
5,133,939 A * 7/1992 Mahe ..... B01L 9/06 211/74
6,182,719 B1 * 2/2001 Yahiro ..... B01L 9/543 141/1
2008/0075634 A1 * 3/2008 Herchenbach ..... B01L 9/06 422/400
2009/0293643 A1 12/2009 Powell et al.
(Continued)

*Primary Examiner* — Ryan D Walsh
(74) *Attorney, Agent, or Firm* — Tarolli, Sundheim, Covell & Tummino LLP

(57) ABSTRACT

An apparatus for limiting pipette head travel with respect to a ground surface, and for limiting insertion of a pipette into a tube, has a top surface including at least one aperture. Each aperture selectively and concurrently accepts a corresponding pipette head of a pipette device therethrough. A bottom surface extends substantially parallel to the top surface and selectively contacts the ground surface. A plurality of side surfaces extends transversely between the top and bottom surfaces. The side surfaces each have a predetermined height correlated with a desired minimum approach distance of each pipette head toward the ground surface. The top, bottom, and side surfaces collectively enclose and define a spacer volume, at least partially through which each pipette corresponding to a pipette head extends. Methods of limiting pipette head travel with respect to a ground surface, and of limiting insertion of a pipette into a tube, are also provided.

22 Claims, 4 Drawing Sheets

(56) References Cited

U.S. PATENT DOCUMENTS

| | | | | |
|---|---|---|---|---|
| 2012/0051987 | A1* | 3/2012 | Johnson | B01L 9/06 422/562 |
| 2015/0174579 | A1 | 6/2015 | Iten et al. | |
| 2015/0336102 | A1* | 11/2015 | Tyagi | B66F 11/00 422/562 |

* cited by examiner

PIPETTE TRAVEL LIMITING APPARATUS

GOVERNMENT SUPPORT

This invention was made with government support under government contract number HHSO100201000002C awarded by ASPR-BARDA. The government has certain rights in the invention.

TECHNICAL FIELD

This disclosure relates to an apparatus and method for limiting pipette head travel with respect to a ground surface, and, more particularly, to a method and apparatus for limiting insertion of a pipette into a tube.

BACKGROUND

In laboratory settings, a single pipette and/or a multi-pipette device may be used to pipette fluids into and out of tubes ("tubes" is used herein to also indicate wells of a multiplate). When aspirating tubes, microplate processing steps may desire to leave a defined residual volume in the wells—for example, to avoid disturbing or aspirating particles in the bottoms of the tubes. Certain processing steps require consistent remaining volumes or undisturbed pellets in the bottoms of the tubes. However, handheld multi-pipette devices make this defined-level aspiration a manual, subjective process. This is exacerbated in high-throughput applications, which require numerous different operators, multiple sites, and a large quantity of results, sometimes over many days. Fully-automated liquid handling robots are commercially available, but they are very expensive and require a different skillset for operation than the skills available to the typical laboratory operator. Truly consistent defined-level aspiration results are not achievable with the current manually operated multi-pipette devices.

SUMMARY

In an embodiment, an apparatus for limiting pipette head travel with respect to a ground surface is described. A top surface includes at least one aperture. Each aperture selectively and concurrently accepts a corresponding pipette head of a pipette device therethrough. A bottom surface extends substantially parallel to the top surface and selectively contacts the ground surface. A plurality of side surfaces extends transversely between the top and bottom surfaces. The side surfaces each have a predetermined height correlated with a desired minimum approach distance of each pipette head toward the ground surface. The top, bottom, and side surfaces collectively enclose and define a spacer volume, at least partially through which each pipette corresponding to a pipette head extends.

In an embodiment, an apparatus for controlling a depth of manual insertion of a plurality of pipettes into a corresponding plurality of tubes is described. A multi-pipette device includes a plurality of pipette heads having pipettes of a transverse tube length depending therefrom. A spacer block includes a top surface including a plurality of apertures, a bottom surface, extending substantially parallel to the top surface, and a plurality of side surfaces extending transversely between the top and bottom surfaces. The side surfaces each have a predetermined height correlated with a desired minimum approach distance of the pipette heads toward an underlying ground surface and a plurality of tubes associated with the ground surface. The spacer block physically interferes with movement of the multi-pipette device transversely downward toward the ground surface greater than a transverse spacer distance. The transverse spacer distance is directly correlated with a desired insertion depth of the plurality of pipettes into the plurality of tubes.

In an embodiment, a method of limiting insertion of a pipette into a tube is described. A spacer block is provided, including a top surface including a plurality of apertures, a bottom surface extending substantially parallel to the top surface, and a plurality of side surfaces extending transversely between the top and bottom surfaces. The side surfaces each have a predetermined height correlated with a desired minimum approach distance of the pipette heads toward an underlying ground surface. A spacer volume is collectively enclosed and defined with the top, bottom, and side surfaces of the spacer block. A multi-pipette device is provided. The multi-pipette device includes a plurality of pipette heads each having a corresponding pipette depending therefrom. Each of the plurality of pipette heads is concurrently placed through a corresponding aperture of the top surface to associate the spacer block with the multi-pipette device. At least one pipette is aligned with a corresponding tube associated with the ground surface. The multi-pipette device and associated spacer block are moved transversely downward to insert the at least one pipette into a top of the corresponding tube. The multi-pipette device and associated spacer block continue to be moved transversely downward to substantially place each tube into fluid contact with the spacer volume. The bottom surface of the spacer block is brought into contact with the ground surface to prevent movement of the multi-pipette device transversely downward further than the desired minimum approach distance.

BRIEF DESCRIPTION OF THE DRAWINGS

For a better understanding, reference may be made to the accompanying drawings, in which.

DESCRIPTION OF ASPECTS OF THE DISCLOSURE

Figure 1:
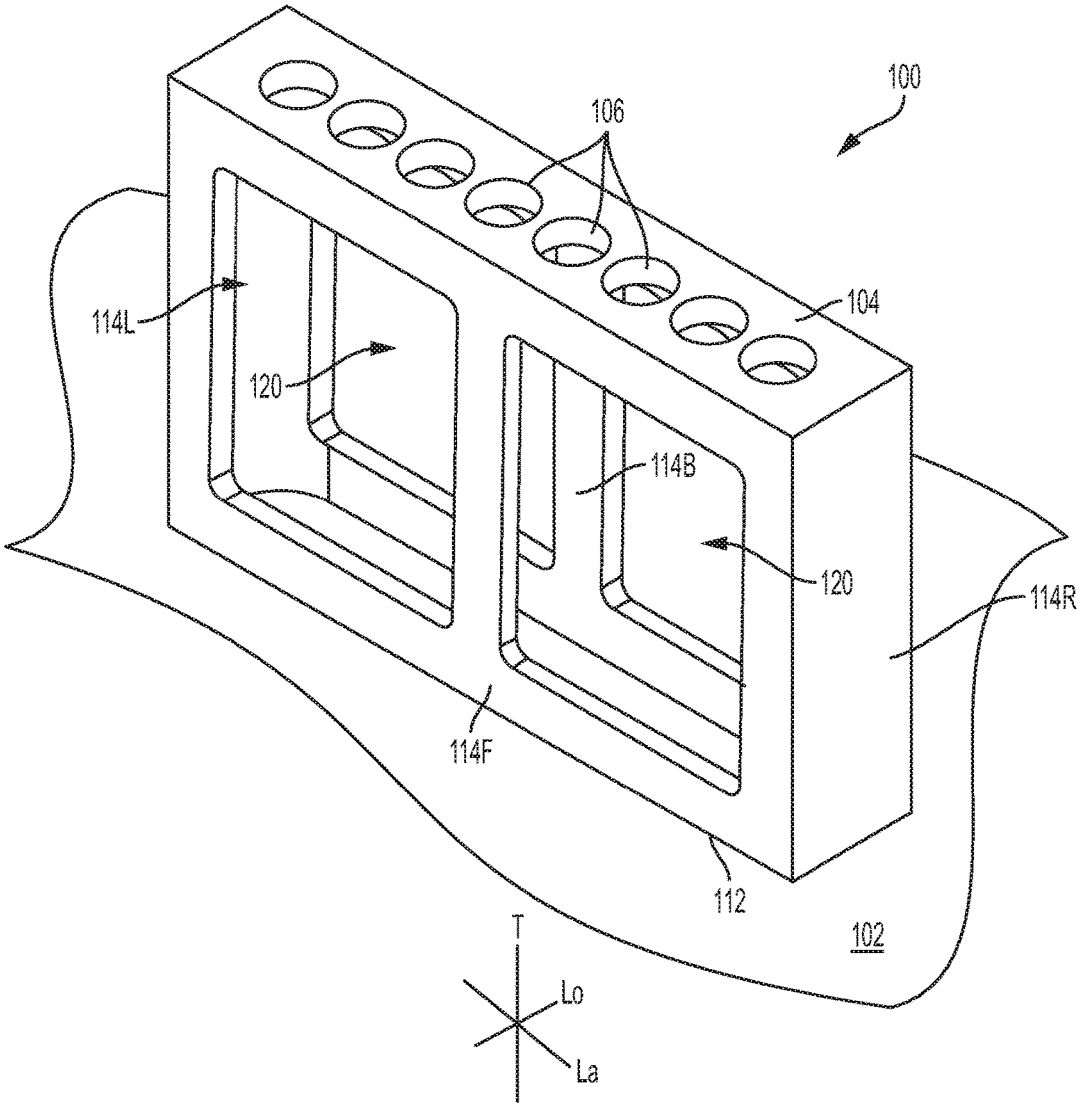
FIG. 1 is a perspective front view of one aspect of the invention.
Figure 2:
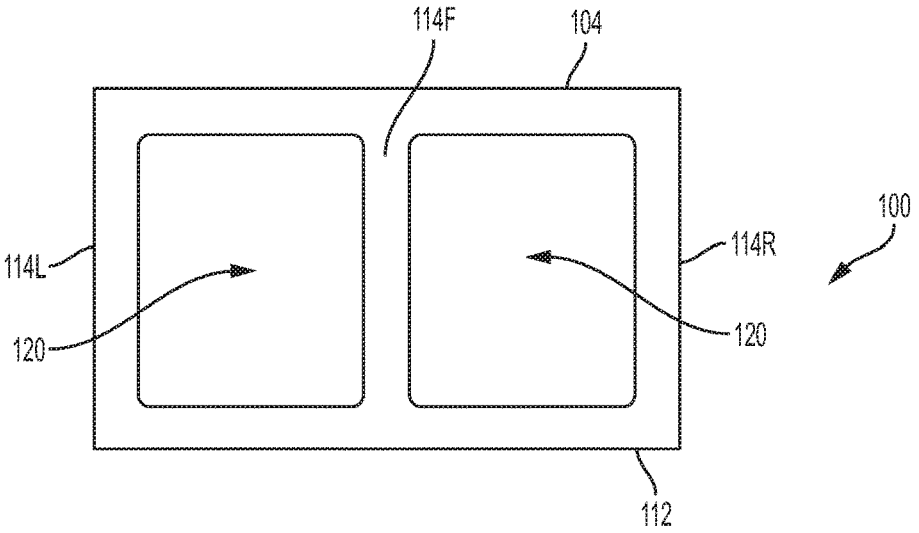
FIG. 2 is a front view of the aspect of FIG. 1.
Figure 3:
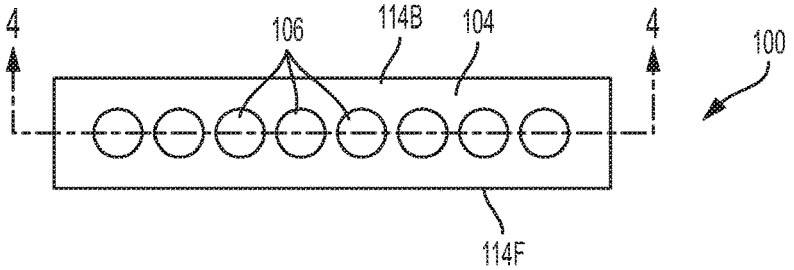
FIG. 3 is a top view of the aspect of FIG. 1.

This technology comprises, consists of, or consists essentially of the following features, in any combination.

FIGS. 1-4 depict an apparatus 100 for limiting pipette head travel with respect to a ground surface 102. The apparatus 100 may be made of any desired material, and in any desired manner, such as 3D-printed (e.g., additively manufactured) from plastic, metal, or any other material, or machined from a block of any desired material. For example, the apparatus 100 could be made at least partially from plastic, such as, but not limited to, ULTEM™ (polyetherimide) resin, available from Saudi Basic Industries Corporation (SABIC) of Riyadh, Saudi Arabia, and/or acrylonitrile butadiene styrene ("ABS"). For most use environments, the apparatus 100 will desirably be substantially rigid, and to resist compressive force. In addition, it will often be desirable for the apparatus 100 to be able to be made while holding to fairly tight manufacturing tolerances, to resist deterioration arising from exposure to common laboratory chemicals/substances, and also to be sterilizable.

The apparatus 100 includes a top surface 104 including at least one aperture 106. Each aperture 106 selectively and concurrently (with the other apertures 106) accepts a corresponding pipette head 508 of a pipette device, which could be a single pipette device or a multi-pipette device 510 (shown in FIGS. 5A-5C) therethrough. While the below description uses a multi-pipette device 510 as an example, the pipette device may have any desired number (one or more) pipettes and corresponding pipette heads, as appropriate for a particular use environment. One or more apertures 106 may be sized for a frictional ("interference") fit with the corresponding pipette heads 508, to grasp the pipette heads 508 with a predetermined holding force and thus passively hold the apparatus 100 onto the multi-pipette device 510. Alternately, one or more apertures 106 may be sized to surround a corresponding pipette head 508 in a surrounding spaced relationship, such that a user or other "third party" structure (e.g., a strap or latch, not shown) must affirmatively act to hold the apparatus 100 in a desired relationship with the multi-pipette device 510.

A bottom surface 112 of the apparatus 100 extends substantially parallel to the top surface 104, is transversely spaced therefrom, and selectively contacts the ground surface. The "transverse" direction is shown as the substantially up/down direction in FIG. 1, via the orthogonal indication in that Figure. The other orthogonal direction labels used to aid this description, also shown in FIG. 1, are longitudinal (substantially front/back relative to the apparatus 100) and lateral (substantially left/right relative to the apparatus 100).

A plurality of side surfaces (referenced collectively as 114) each extend transversely between the top and bottom surfaces 102 and 112. The side surfaces 114 each have a predetermined height correlated with a desired minimum approach distance of the pipette heads 508 toward the ground surface 102, as will be further discussed below. The plurality of side surfaces may include longitudinally spaced and mutually parallel front and back surfaces 114F and 114B, respectively, and laterally spaced and mutually parallel left and right side surfaces 114L and 114R, respectively. Optionally, the bottom surface 112 may be defined by the lowermost edges 416 of the plurality of side surfaces 114, rather than being a separately provided "bottom surface" element. Also optionally, the bottom surface 112 may be contoured or otherwise configured to engage a feature of the ground surface 102 as desired, such as to orient or position the apparatus 100 into a predetermined position with respect to the ground surface 102.

Figure 4:
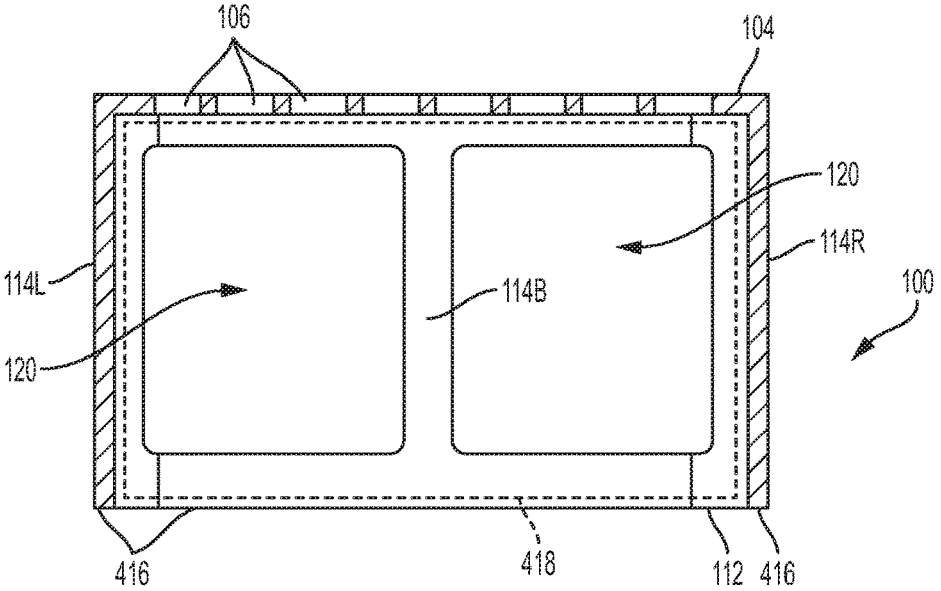
FIG. 4 is a cross-sectional view taken along line 4-4 of FIG. 3.

The top, bottom, and side surfaces 102, 112, and 114 collectively enclose and define a spacer volume (shown schematically at 418 in FIG. 4). The spacer volume 418 of the apparatus 100 shown in the Figures is substantially a rectangular prism, or cuboid, due to the matched dimensions of the front and back surfaces 114F and 114B and the left and right side surfaces 114L and 114R. However, one of ordinary skill in the art could configure the various elements making up the apparatus 100 to "tune" the space volume 418 into any desired three-dimensional shape for a particular use environment.

At least one side surface 114 (shown on front and back surfaces 114F and 114B) may include a viewing port 120 extending therethrough and permitting visual contact between the spacer volume 418 and an ambient space. The viewing port 120, when present, may be an aperture penetrating through the associated side surface 114, permitting fluid communication between the spacer volume 418 and an ambient space. Alternately, the viewing port 120 may be a transparent or translucent portion of the side surface 114, and may be either integrally formed with the remainder of the side surface 114, such as via a different additive manufacturing material or an overmolding process, or may be provided to the side surface 114 after manufacture of the side surface 114. It is contemplated that the entirety of one or more side surfaces 114 could be translucent and/or transparent to provide visual contact between the spacer volume 418 and the ambient space—in such an arrangement, the entirety of that side surface could be considered to be a viewing port 120.

Figure 5A:
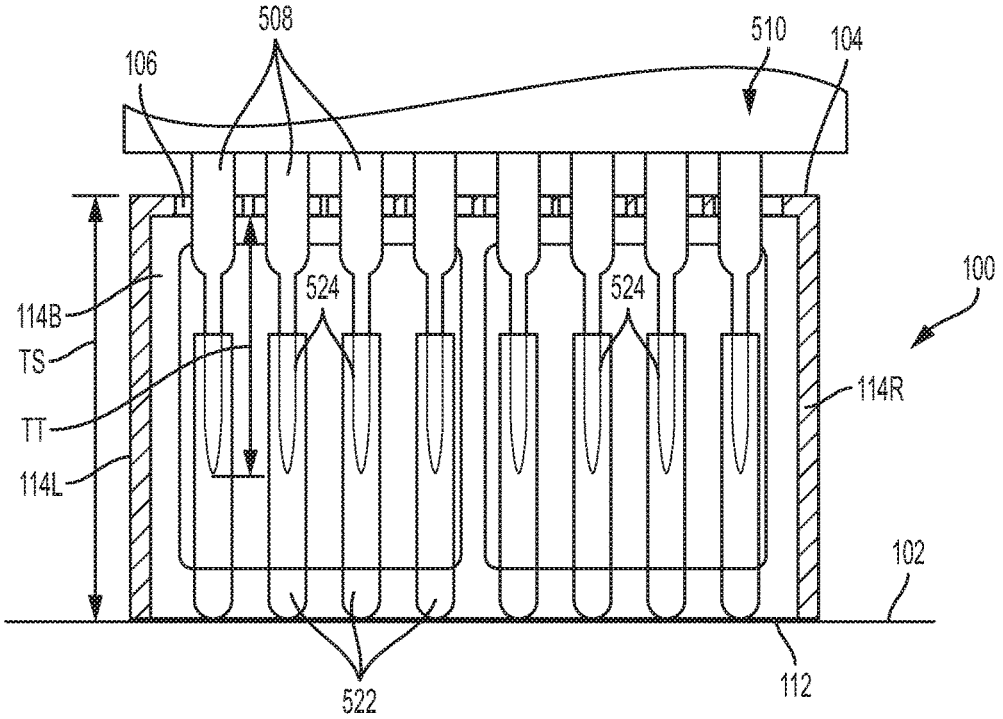
FIGS. 5A-5C depict the aspect of FIG. 1 in example use environments.
Figure 5B:
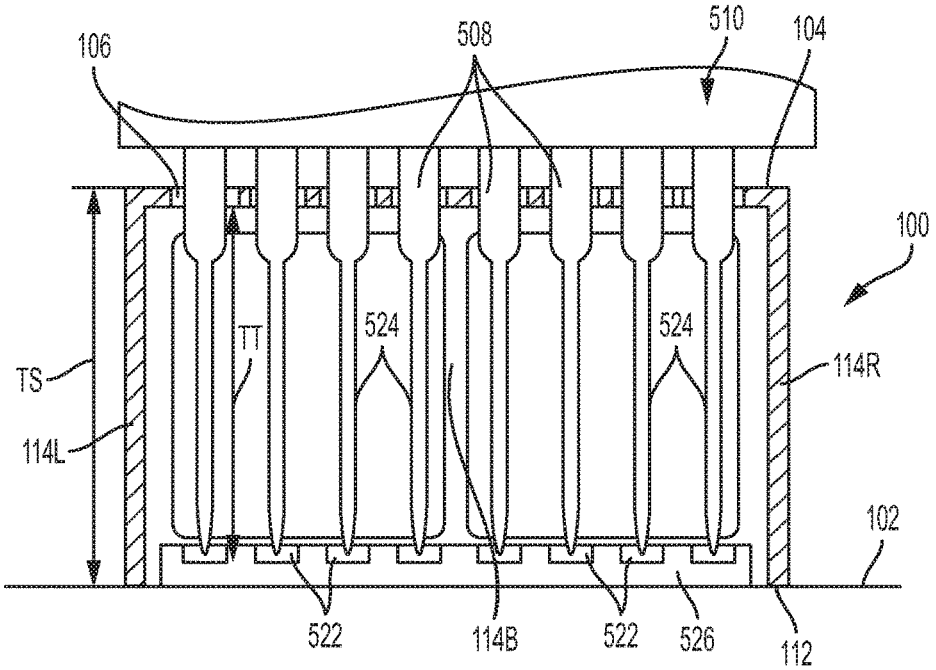
Figure 5C:
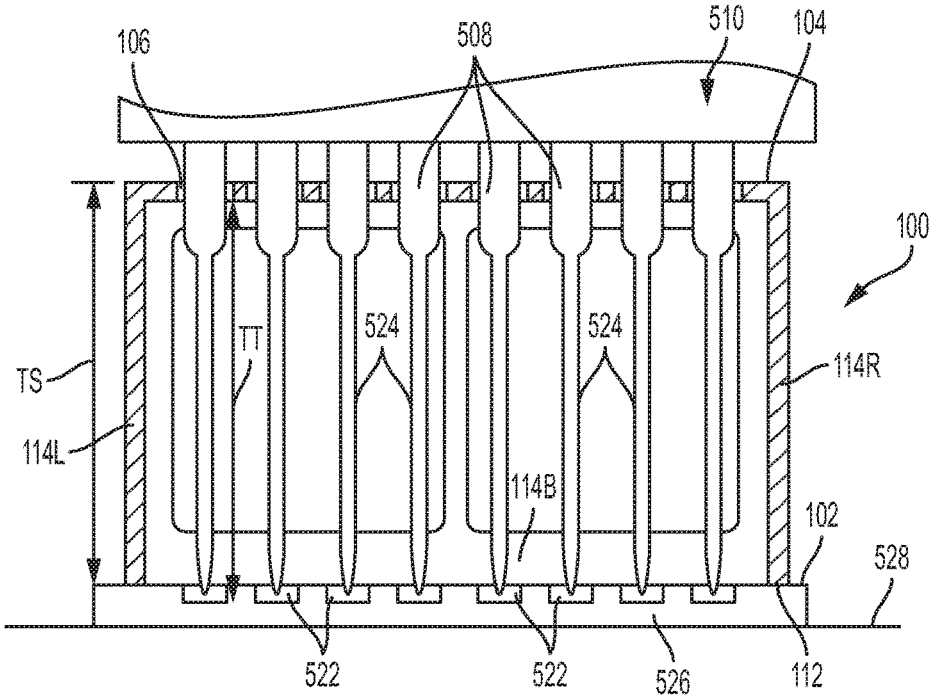

Turning to the various use environments depicted schematically in FIGS. 5A-5C, the top surface 104 of the apparatus 100 is supported by the side surfaces 114 to resist a downward force applied by the multi-pipette device 510 when the bottom surface 112 of the apparatus 100 is contacting the ground surface 102. (As the term is used herein, "contacting the ground surface" encompasses direct contact and adjacent-but-indirect contact—e.g., with an intermediate structure, such as a microplate, imposed transversely therebetween—but does not include spaced-indirect contact such as being held by an armature that is itself in contact with the ground surface.)

Stated otherwise, the side surfaces 114 each have a predetermined height (in the transverse direction) which is correlated with a desired minimum approach distance of the pipette heads 508 toward an underlying ground surface 102 and, thus, toward a plurality of tubes 522 associated with the ground surface 102. (The term "tube" is used herein to indicate a vessel of any size and shape which contains a fluid which is to be the subject of a pipetting operation, including test tubes and the wells of a microplate.) The apparatus 100 then serves as a spacer block 100, physically interfering with movement of the multi-pipette device 510 transversely downward toward the ground surface 102 by an amount greater than a transverse spacer distance. The transverse spacer distance is directly correlated with a desired insertion depth of a plurality of pipettes 524 (each pipette 524 being held by a pipette head 508) into the plurality of tubes 522.

FIG. 5A depicts an example use environment where a plurality of tubes 522—shown here as test tubes—are associated with the ground surface 102 by sitting atop the ground surface 102. (In FIG. 5A, the tubes 522 may be held by a stand, which is omitted for clarity of depiction.) FIGS. 5B-5C show example use environments where the tubes 522 are each wells of a microplate 526.

In FIG. 5B, the microplate 526 has a smaller footprint, in a lateral-longitudinal plane, which fits entirely within a similarly oriented footprint of the spacer volume 418, so the microplate 526 of FIG. 5B is located within the spacer volume 418 when the bottom surface 112 of the apparatus 100 directly contacts the ground surface 102. The tubes 522 of FIG. 5B are associated with the ground surface 102 by being formed in a microplate 526 which is supported directly by the ground surface 102—thus these tubes 522, like those of FIG. 5A, sit atop the ground surface 102.

In contrast, FIG. 5C shows an arrangement where the microplate 526 has a larger footprint, in a lateral-longitudinal plane, than that of the spacer volume 418. Accordingly, the bottom surface 112 of the apparatus 100 rests atop the microplate 526, and the top surface of the microplate 526 is acting as the ground surface 102 in FIG. 5C. Thus, the tubes 522 of FIG. 5C are associated with the "ground surface" 102 (with which the apparatus 100 interacts) by actually protruding transversely downward into the ground surface 102.

However, in FIG. 5C, the microplate 526 itself is shown resting on a tabletop 528. One of ordinary skill in the art could configure the apparatus 100 as desired to interact with the top surface of the microplate 526 (acting as a ground surface 102) and/or with the tabletop 528 for a particular use application of the apparatus 100.

Taking a broader view of FIGS. 5A-5C, now that the similarities and differences between these example use environments have been briefly discussed, each pipette 524 corresponding to the pipette heads 508 extends transversely at least partially through the spacer volume 418 downward from a corresponding pipette head 508. The spacer volume 418 is then placed in direct fluid communication with at least one tube 522 associated with the ground surface 102, and into which a pipette 524 corresponding to (and depending from) a pipette head 508 is to be inserted. The pipettes 524 each have a transverse tube length, which is an effective length of the pipette 524 (which could include a portion of the pipette head 508) measured transversely downward from the top surface 104 of the apparatus 100. In many use environments, the transverse tube length of each of the plurality of pipettes 524 of a single multi-pipette device 510 will be substantially similar, to provide desirably repeatable and consistent pipetting results. However, it is also contemplated that some variability of transverse tube length across the plurality of pipettes 524 of a single multi-pipette device could be intentionally provided to obtain different pipetting results across a plurality of tubes 522 (for example, to leave more fluid after aspiration in each of the leftmost tubes 522 of an array of tubes 522).

For situations like those shown in FIGS. 5A-5B, where the bottom surface 112 of the apparatus 100 substantially surrounds the tubes 522, and any associated microplate 526, in a lateral-longitudinal plane, the spacer volume 418 may substantially surround at least one tube 522 resting on the ground surface 102 and into which a pipette 524 corresponding to the pipette head 508 is inserted, as shown. In this case, the apparatus 100 has a transverse spacer distance (TS, in FIGS. 5A-5B) which is larger than the transverse tube length (TT, in FIGS. 5A-5B) of the pipettes 524, because the plurality of tubes 522 each protrude transversely upward from the ground surface 102, and it would be undesirable to contact the bottoms of the tubes 522 with the pipettes 524 before contact between the bottom surface 112 and the ground surface 102 stops downward movement of the apparatus 100 (and, thus, the associated multi-pipette device 510). The pipettes 524 in FIGS. 5A-5B are also, once exiting the pipette heads 508, each entirely contained within the spacer volume 418.

In contrast, FIG. 5C shows a situation in which each pipette 524 extends through and transversely beneath the spacer volume 418, for insertion into a tube 522 recessed below the ground surface 102. That is, the transverse spacer distance TS is smaller than the transverse tube length TT in FIG. 5C (although neither this nor any other Figure is shown to scale), such that the pipettes 524 can reach "below" the apparatus and into the plurality of tubes 522 protruding transversely downward into the ground surface.

Figure 6:
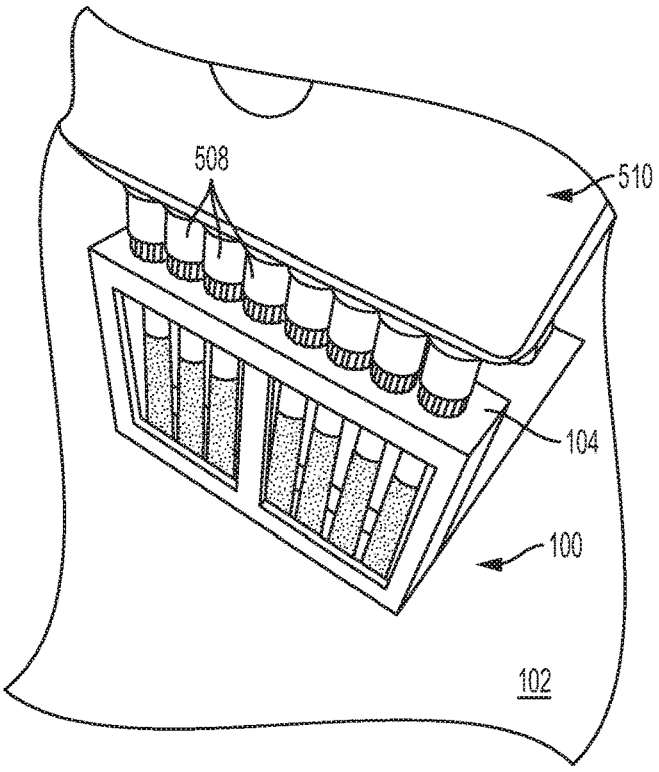
FIG. 6 is a top perspective view of the aspect of FIG. 1 in an example use environment.

FIG. 6 shows an apparatus 100 associated with a multi-pipette device 510, and the operation of this combination will now be described. For the sake of the below description, the apparatus 100 will be presumed to be grasping the multi-pipette device 510 via frictional engagement between the apertures 106 of the top surface 104 and the pipette heads 508, but one of ordinary skill in the art will be able to modify the below description to accommodate a spaced surrounding relationship between the apertures 106 of the top surface 104 and the pipette heads 508, instead, as appropriate.

To achieve the FIG. 6 combination, each of the plurality of pipette heads 508 is concurrently placed through a corresponding aperture 106 of the top surface 104 to associate the apparatus 100, which can also be considered to be a spacer block 100, with the multi-pipette device 510. At least one pipette 524 is then aligned, in a lateral-longitudinal sense, with a corresponding tube 522 associated with the ground surface 102.

The multi-pipette device 510 and associated apparatus 100 are moved transversely downward (once the aforementioned alignment has been made) to insert the at least one pipette 524 into a top of the corresponding tube 522. Once this initial insertion is made, the multi-pipette device 510 and associated apparatus 100 are continued to move transversely downward to substantially place each tube 522 into fluid contact with the spacer volume 418.

The bottom surface 112 of the apparatus 100 is brought into contact with the ground surface 102 to prevent movement of the multi-pipette device 510 transversely downward further than the desired minimum approach distance of the multi-pipette device 510 toward the ground surface 102. It should be noted that this desired minimum approach distance bears a direct (though not necessarily identical) relationship to a height, in the transverse direction, of the apparatus 100.

When, as in FIGS. 5A-5B, the tubes 522 are substantially accepted into the spacer volume 418, by virtue of sitting atop the ground surface 102, the uppermost portions of the tubes 522 are accepted into the spacer volume 418 during the initial stages of the process of inserting the pipettes 524 into the tubes 522. The pipettes 524 in an arrangement similar to that of FIGS. 5A-5B remain enclosed within the spacer volume 418.

In contrast, as in FIG. 5C, the tubes 522 are merely placed into fluid communication with the spacer volume 418 because the tubes 522 protrude transversely below the ground surface 102. Accordingly, the pipettes 524 in an arrangement similar to that of FIG. 5C may, for some use environments, protrude transversely below the spacer volume 418.

Regardless of the exact nature of the relative configurations and locations of the pipettes 524, tubes 522, and spacer volume 418 or other structures of the apparatus 100, however, it should be understood that the apparatus 100 can be used to limit an insertion depth of the pipettes 524 into the tubes 522 by blocking downward travel of the multi-pipette device 510 beyond a predetermined distance with respect to the ground surface 102, in order to provide reproducible and consistent pipetting (e.g., aspiration) operations, such as in a laboratory bench environment. This property may be particularly desirable when the multi-pipette device 510 and associated apparatus 100 are being moved manually by a user. The phrase "moved manually by a user" and variants thereof, as used herein, are intended to indicate that a human user is hand-holding the multi-pipette device 510 (directly or indirectly) and providing motive power almost entirely through the use of human muscles (which could, however, be mechanically transferred and/or multiplied by a gantry linkage or the like). "Manually" is used herein to distinguish from a situation wherein a wholly or majority robotic device is used to position and move the multi-pipette device 510 under non-human-provided motive power. When a non-manual pipetting arrangement is provided (e.g., in a chemical manufacturing facility), the robotic control and/or powering is generally sufficient to achieve desired repeatability and consistency in pipetting results, so there would be no reason for one of ordinary skill in the art to use an apparatus 100 as described and shown herein.

While aspects of this disclosure have been particularly shown and described with reference to the example embodiments above, it will be understood by those of ordinary skill in the art that various additional embodiments may be contemplated. For example, the specific methods described above for using the apparatus are merely illustrative; one of ordinary skill in the art could readily determine any number of tools, sequences of steps, or other means/options for placing the above-described apparatus, or components thereof, into positions substantively similar to those shown and described herein. The bottom surface 112 of the apparatus 100 would still be considered to "substantially surround" a structure even if there are discontinuities in the lateral-longitudinal plane of the structures making up the bottom surface 112 (e.g., "mousehole" type notches extending from the lowermost edges 416 up into the bodies of one or more side surfaces 114)—the side surfaces 114 could even be skeletal to the point of consisting mainly of elongated legs extending downward from the top surface 104. Any of the described structures and components could be integrally formed as a single unitary or monolithic piece or made up of separate sub-components, with either of these formations involving any suitable stock or bespoke components and/or any suitable material or combinations of materials. Any of the described structures and components could be disposable or reusable as desired for a particular use environment. Any component could be provided with a user-perceptible marking to indicate a material, configuration, at least one dimension, or the like pertaining to that component, the user-perceptible marking aiding a user in selecting one component from an array of similar components for a particular use environment. A "predetermined" status may be determined at any time before the structures being manipulated actually reach that status, the "predetermination" being made as late as immediately before the structure achieves the predetermined status. Though certain components described herein are shown as having specific geometric shapes, all structures of this disclosure may have any suitable shapes, sizes, configurations, relative relationships, cross-sectional areas, or any other physical characteristics as desirable for a particular application. Any structures or features described with reference to one embodiment or configuration could be provided, singly or in combination with other structures or features, to any other embodiment or configuration, as it would be impractical to describe each of the embodiments and configurations discussed herein as having all of the options discussed with respect to all of the other embodiments and configurations. A device or method incorporating any of these features should be understood to fall under the scope of this disclosure as determined based upon the claims below and any equivalents thereof.

Other aspects, objects, and advantages can be obtained from a study of the drawings, the disclosure, and the appended claims.

We claim:

1. An apparatus for limiting pipette head travel with respect to a ground surface, the apparatus comprising:

a top surface including at least one aperture, each aperture selectively and concurrently accepting a corresponding pipette head of a pipette device therethrough, with at least one aperture accepting the corresponding pipette head in a frictional fit engagement;

a bottom surface, extending substantially parallel to the top surface and selectively contacting the ground surface; and a plurality of side surfaces extending transversely between the top and bottom surfaces, the side surfaces each having a predetermined height correlated with a desired minimum approach distance of each pipette head toward the ground surface;

the top, bottom, and side surfaces collectively enclosing and defining a spacer volume, at least partially through which each pipette corresponding to a pipette head extends.

2. The apparatus of claim 1, wherein at least one aperture is sized to surround a corresponding pipette head in a spaced relationship.

3. The apparatus of claim 1, wherein the side surfaces consist of longitudinally spaced and mutually parallel front and back surfaces, and laterally spaced and mutually parallel left and right side surfaces.

4. The apparatus of claim 1, wherein at least one side surface includes a viewing port extending therethrough and permitting visual contact between the spacer volume and an ambient space.

5. The apparatus of claim 4, wherein the viewing port is an aperture through the side surface, permitting fluid communication between the spacer volume and an ambient space.

6. The apparatus of claim 1, wherein the bottom surface is defined by the lowermost edges of the plurality of side surfaces.

7. The apparatus of claim 1, wherein the top surface is supported by the side surfaces to resist a downward force applied by the pipette device when the bottom surface is contacting the ground surface.

8. The apparatus of claim 1, wherein the spacer volume is in direct fluid communication with at least one tube associated with the ground surface and into which a pipette corresponding to the pipette head is to be inserted.

9. The apparatus of claim 1, wherein each pipette extends through and transversely beneath the spacer volume, for insertion into a tube recessed below the ground surface.

10. The apparatus of claim 1, wherein the spacer volume substantially surrounds at least one tube resting on the ground surface and into which a pipette corresponding to the pipette head is inserted.

11. An apparatus for controlling a depth of manual insertion of a plurality of pipettes into a corresponding plurality of tubes, the apparatus comprising:

a multi-pipette device, including a plurality of pipette heads having pipettes of a transverse tube length depending therefrom; and a spacer block, including a top surface including a plurality of apertures, at least one aperture accepting at least a portion of a corresponding pipette head in a frictional fit engagement, a bottom surface, extending substantially parallel to the top surface, and a plurality of side surfaces extending transversely between the top and bottom surfaces, the side surfaces each having a predetermined height correlated with a desired minimum approach distance of the pipette heads toward an underlying ground surface and a plurality of tubes associated with the ground surface;

the spacer block physically interfering with movement of the multi-pipette device transversely downward toward the ground surface greater than a transverse spacer distance, and the transverse spacer distance being directly correlated with a desired insertion depth of the plurality of pipettes into the plurality of tubes.

12. The apparatus of claim 11, wherein at least one aperture is sized to surround a corresponding pipette head in a spaced relationship.

13. The apparatus of claim 11, wherein at least one side surface includes a viewing port extending therethrough and permitting visual contact between the spacer volume and an ambient space.

14. The apparatus of claim 11, wherein the transverse spacer distance is larger than the transverse tube length, and the plurality of tubes protrude transversely upward from the ground surface.

15. The apparatus of claim 11, wherein the transverse spacer distance is smaller than the transverse tube length, and the plurality of tubes protrude transversely downward into the ground surface.

16. A method of limiting insertion of a pipette into a tube, the method comprising:

providing a spacer block including a top surface including a plurality of apertures, a bottom surface, extending substantially parallel to the top surface, and a plurality of side surfaces extending transversely between the top and bottom surfaces, the side surfaces each having a predetermined height correlated with a desired minimum approach distance of the pipette heads toward an underlying ground surface;

with the top, bottom, and side surfaces of the spacer block, collectively enclosing and defining a spacer volume;

providing a multi-pipette device including a plurality of pipette heads each having a corresponding pipette depending therefrom;

concurrently placing each of the plurality of pipette heads through a corresponding aperture of the top surface, with at least one aperture accepting the corresponding pipette head in a frictional fit engagement, to associate the spacer block with the multi-pipette device;

aligning at least one pipette with a corresponding tube associated with the ground surface;

moving the multi-pipette device and associated spacer block transversely downward to insert the at least one pipette into a top of the corresponding tube;

continuing to move the multi-pipette device and associated spacer block transversely downward to substantially place each tube into fluid contact with the spacer volume; and bringing the bottom surface of the spacer block into contact with the ground surface to prevent movement of the multi-pipette device transversely downward further than the desired minimum approach distance.

17. The method of claim 16, wherein concurrently placing each of the plurality of pipette heads through a corresponding aperture of the top surface to associate the spacer block with the multi-pipette device includes placing at least one of the pipette heads into a spaced surrounding relationship with the apertures.

18. The method of claim 16, including permitting visual contact between the spacer volume and an ambient space through a viewing port extending through at least one side surface.

19. The method of claim 18, including permitting fluid communication between the spacer volume and an ambient space through a viewing port which is an aperture through the side surface.

20. The method of claim 16, wherein moving the multi-pipette device and associated spacer block includes manually moving the multi-pipette device and associated spacer block by a user.

21. The method of claim 16, wherein providing a multi-pipette device includes providing a plurality of pipette heads having pipettes of a transverse tube length depending therefrom, the transverse tube length being smaller than the height of the side surfaces such that the pipettes are entirely enclosed within the spacer volume;

wherein moving the multi-pipette device and associated spacer block transversely downward includes inserting the at least one pipette into a top of the corresponding tube and accepting at least an uppermost portion of the tubes into the spacer volume; and wherein continuing to move the multi-pipette device and associated spacer block includes moving the multi-pipette device and associated spacer block transversely downward to substantially accept the tubes into the spacer volume.

22. The method of claim 16, wherein providing a multi-pipette device includes providing a plurality of pipette heads having pipettes of a transverse tube length depending therefrom, the transverse tube length being larger than the height of the side surfaces such that the pipettes protrude transversely below the spacer volume; and wherein aligning at least one pipette with a corresponding tube associated with the ground surface includes aligning at least one pipette with a corresponding tube protruding transversely below the ground surface.

* * * * *